US008494413B2

(12) United States Patent
Ichiki et al.

(10) Patent No.: US 8,494,413 B2
(45) Date of Patent: Jul. 23, 2013

(54) FIXING DEVICE, SINGLE-SIDED IMAGE FORMING APPARATUS, AND DOUBLE-SIDED IMAGE FORMING APPARATUS

(75) Inventors: Yukihiro Ichiki, Kanagawa (JP); Satoshi Isahai, Saitama (JP); Yasuo Suzuki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 248 days.

(21) Appl. No.: 12/868,252

(22) Filed: Aug. 25, 2010

(65) Prior Publication Data

US 2011/0236067 A1 Sep. 29, 2011

(30) Foreign Application Priority Data

Mar. 26, 2010 (JP) ..... 2010-073087

(51) Int. Cl.
*G03G 15/16* (2006.01)
*G03G 15/00* (2006.01)

(52) U.S. Cl.
USPC ..... 399/122; 399/401

(58) Field of Classification Search
USPC ..... 399/122, 401, 364
See application file for complete search history.

(56) References Cited

U.S. PATENT DOCUMENTS

2010/0034559 A1* 2/2010 Sahara ..... 399/122

FOREIGN PATENT DOCUMENTS

JP 5-019565 A 1/1993
JP 6-035248 A 2/1994

* cited by examiner

*Primary Examiner* — David Gray
*Assistant Examiner* — Sevan A Aydin
(74) *Attorney, Agent, or Firm* — Sughrue Mion, PLLC

(57) ABSTRACT

A fixing device is provided with a fixing device body, a fixing member, and a first attachment section. The fixing device body is adapted to attach to and detach from an apparatus body of a double-sided image forming apparatus, which has a return passage through which a recording medium is returned to an image forming position, and an apparatus body of a single-sided image forming apparatus, which does not have the return passage. The first attachment section is provided at a return passage side in the fixing device body, and is adapted to have a passage surface member, which has a passage surface of an introduction passage through which a fixed recording medium is introduced into the return passage, attached thereto.

13 Claims, 17 Drawing Sheets

FIXING DEVICE, SINGLE-SIDED IMAGE FORMING APPARATUS, AND DOUBLE-SIDED IMAGE FORMING APPARATUS

CROSS-REFERENCE TO RELATED APPLICATIONS

This application is based on and claims priority under 35 USC 119 from Japanese Patent Application No. 2010-073087 filed Mar. 26, 2010.

BACKGROUND

Technical Field

The invention relates to a fixing device, a single-sided image forming apparatus, and a double-sided image forming apparatus.

SUMMARY

According to an aspect of the invention, there is provided a fixing device including: a fixing device body that is adapted to attach to and detach from an apparatus body of a double-sided image forming apparatus which includes a return passage through which a recording medium is returned to an image forming position in order to form an image on both sides of the recording medium, and of a single-sided image forming apparatus which does not include the return passage; a fixing member that is provided in the fixing device body and that fixes an image to the recording medium; and a first attachment section that is provided at a return passage side in the fixing device body and that is adapted to have a passage surface member, which includes a passage surface of an introduction passage through which a fixed recording medium on which an image has been fixed by the fixing member is introduced into the return passage, attached thereto.

BRIEF DESCRIPTION OF THE DRAWINGS

Exemplary embodiments of the present invention will be described in detail based on the following figures, wherein.

DETAILED DESCRIPTION

Hereinafter, an example of an exemplary embodiment of the invention will be described based on the drawings.

(Constitution of Double-Sided Image Forming Apparatus 10 According to the Exemplary Embodiment)

Figure 1:
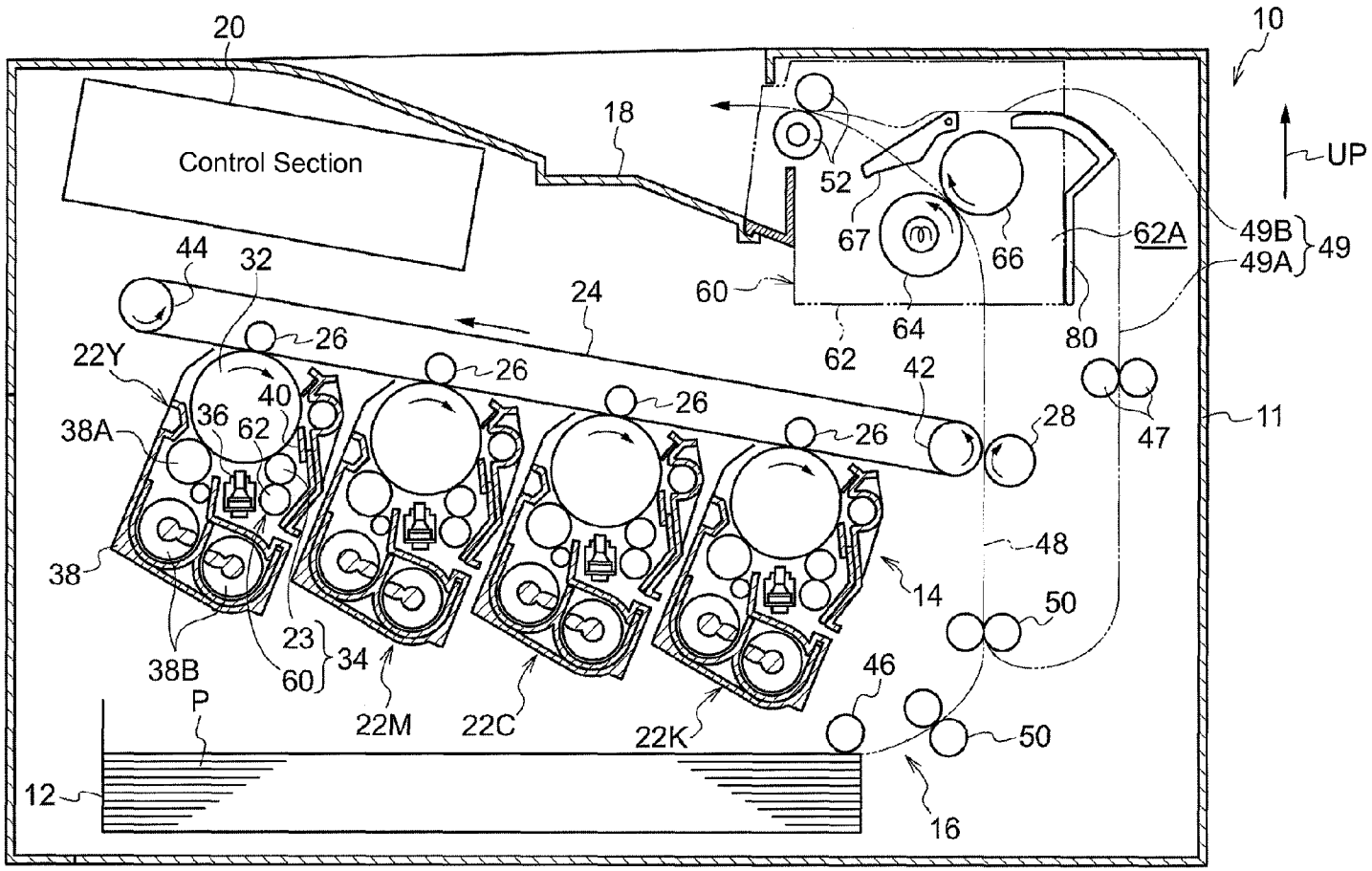
FIG. 1 is a schematic view showing a constitution of a double-sided image forming apparatus according to an exemplary embodiment of the invention.

First, a constitution of a double-sided image forming apparatus 10 according the exemplary embodiment will be described. FIG. 1 is a schematic view showing the constitution of the double-sided image forming apparatus 10 according to the exemplary embodiment. The arrow UP shown in FIG. 1 shows the upper side in the vertical direction.

The double-sided image forming apparatus 10 according to the exemplary embodiment is an image forming apparatus for double-sided image formation, which may form an image on both front and rear sides of a recording medium P. As shown in FIG. 1, the double-sided image forming apparatus 10 has an image forming apparatus body 11 accommodating therein each component.

The image forming apparatus body 11 includes an accommodating section 12 which accommodates the recording media P such as sheets, an image forming section 14 which forms an image on the recording medium P, a conveying section 16 which conveys the recording medium P from the accommodating section 12 to the image forming section 14, and a control section 20 which controls the operation of each section of the double-sided image forming apparatus 10. The image forming apparatus body 11 has in its upper portion an ejecting section 18 to which the recording medium P formed with an image by the image forming section 14 is ejected.

The image forming section 14 is provided with image forming units 22Y, 22M, 22C, and 22K (hereinafter shown as 22Y to 22K) forming a toner image of each color of yellow (Y), magenta (M), cyan (C), and black (K), an intermediate transfer belt 24 to which toner images formed by the image forming units 22Y to 22K are transferred, a first transfer roll 26 transferring the toner images formed by the image forming units 22Y to 22K to the intermediate transfer belt 24, and a second transfer roll 28 transferring the toner images, which is transferred to the intermediate transfer belt 24 by the first transfer roll 26, to the recording medium P. The image forming section 14 may have a different constitution than the above as long as an image is formed on the recording medium P.

The image forming units 22Y to 22K are arranged at the center in the vertical direction of the image forming apparatus body 11 while tilted in the horizontal direction. The image forming units 22Y to 22K each have a photoreceptor 32 rotating in a predetermined direction (for example, in a clockwise direction in FIG. 1). Since the image forming units 22Y to 22K are constituted similarly, the reference numerals of each component of the image forming units 22M, 22C, and 22K are omitted in FIG. 1.

Around each photoreceptor 32, there are sequentially disposed from the upstream side in the rotating direction of the photoreceptor 32: a charging roll 23 as an example of a charging device charging the photoreceptor 32; an exposure device 36 which exposes the photoreceptor 32 charged by the charging roll 23 to form an electrostatic latent image on the photoreceptor 32; a developing device 38 which develops the electrostatic latent image, formed on the photoreceptor 32 by the exposure device 36, to form a toner image; and a removing member 40 which is in contact with the photoreceptor 32 to remove a toner remaining on the photoreceptor 32.

The exposure device 36 forms an electrostatic latent image based on an image signal transmitted from the control section 20. As an example of the image signal transmitted from the control section 20, there is an image signal obtained from an external apparatus by the control section 20.

The developing device 38 is provided with a developer supply body 38A supplying a developer to the photoreceptor 32 and plural conveying members 38B conveying the developer applied to the developer supply body 38A while agitating the developer.

The intermediate transfer belt 24 is formed into an annular shape and is disposed at the upper sides of the image forming units 22Y to 22K. The intermediate transfer belt 24 has at its inner peripheral side winding rolls 42 and 44 around which the intermediate transfer belt 24 is wound. Any one of the winding rolls 42 and 44 is rotated and driven, whereby the intermediate transfer belt 24 circulates and moves (rotates) in a predetermined direction (for example, in a counterclockwise direction in FIG. 1) while in contact with the photoreceptor 32. The winding roll 42 is a counter roll facing the second transfer roll 28.

The first transfer roll 26 faces the photoreceptor 32 with the intermediate transfer belt 24 provided between the first transfer roll 26 and the photoreceptor 32. A position between the first transfer roll 26 and the photoreceptor 32 is a first transfer position where a toner image formed on the photoreceptor 32 is transferred to the intermediate transfer belt 24.

The second transfer roll 28 faces the winding roll 42 with the intermediate transfer belt 24 provided between the second transfer roll 28 and the winding roll 42. A position between the second transfer roll 28 and the winding roll 42 is a second transfer position where the toner image transferred to the intermediate transfer belt 24 is transferred to the recording medium P.

The conveying section 16 is provided with a feed roll 46 feeding the recording medium P accommodated in the accommodating section 12, a conveyance passage 48 through which the recording medium P fed by the feed roll 46 is conveyed, plural conveying rolls 50 disposed along the conveyance passage 48 and conveying the recording medium P, fed by the feed roll 46, to the second transfer position.

In the image forming apparatus body 11, a fixing device 60 fixing the toner image, transferred to the recording medium P by the second transfer roll 28, to the recording medium P is provided at the downstream side in the conveying direction from the second transfer position. The fixing device 60 may be removed in the manufacturing process, and a user cannot remove the fixing device 60. The fixing device 60 is provided with an ejection roll 52 ejecting the recording medium P fixed with the toner image to the ejecting section 18. In the double-sided image forming apparatus 10, the fixing device 60 is mounted in such a state that a passage surface member 80 to be described later is attached to a fixing device body 62. A specific constitution of the fixing device 60 will be described later.

The image forming apparatus body 11 has a return passage 49A through which a recording medium formed with an image on one side is returned to a transfer position (an image forming position) in order to form an image on both sides of the recording medium P. A conveying roll 47 conveying the recording medium P is disposed in the return passage 49A.

The fixing device 60 is provided with an introduction passage 49B through which the fixed recording medium P fixed with an image is introduced into the return passage 49A. Specifically, the introduction passage 49B introduces the fixed recording medium P, returned by reverse rotation of the ejection roll 52, to the return passage 49A.

As described above, in the double-sided image forming apparatus 10, the return passage 49A and the introduction passage 49B constitute a reversing passage 49 through which the recording medium P fixed with an image on one side is reversed to be returned to the conveyance passage 48.

Next, an image forming operation for forming an image on the recording medium P in the double-sided image forming apparatus 10 according to the exemplary embodiment will be described.

In the double-sided image forming apparatus 10 according to the exemplary embodiment, the recording medium P fed by the feed roll 46 from the accommodating section 12 is fed into the second transfer position by the plural conveying rolls 50.

Meanwhile, in the image forming units 22Y to 22K, the photoreceptor 32 charged by the charging roll 23 is exposed by the exposure device 36, and an electrostatic latent image is formed on the photoreceptor 32. The electrostatic latent image is developed by the developing device 38 to form a toner image on the photoreceptor 32. The toner image of each color formed in each of the image forming units 22Y to 22K is overlapped on the intermediate transfer belt 24 at the first transfer position to form a color image. The color image formed on the intermediate transfer belt 24 is then transferred to the recording medium P at the second transfer position.

The recording medium P transferred with the toner image is conveyed to the fixing device 60, and the transferred toner image is fixed by the fixing device 60. When an image is formed on only one side of the recording medium P, after a toner image is fixed, the recording medium P is ejected to the ejecting section 18 by the ejection roll 52.

When an image is formed on both sides of the recording medium P, after formation of an image on one side, the recording medium P is reversed by reverse rotation of the ejection roll 52 to be fed into the reversing passage 49. The recording medium P is further fed from the reversing passage 49 into the conveyance passage 48, and an image is formed on the other side in a similar manner to the above, whereby an image is formed on both sides of the recording medium P. As described above, a series of image forming operations are performed.

(Constitution of Single-Sided Image Forming Apparatus 100 According to the Exemplary Embodiment)

Figure 2:
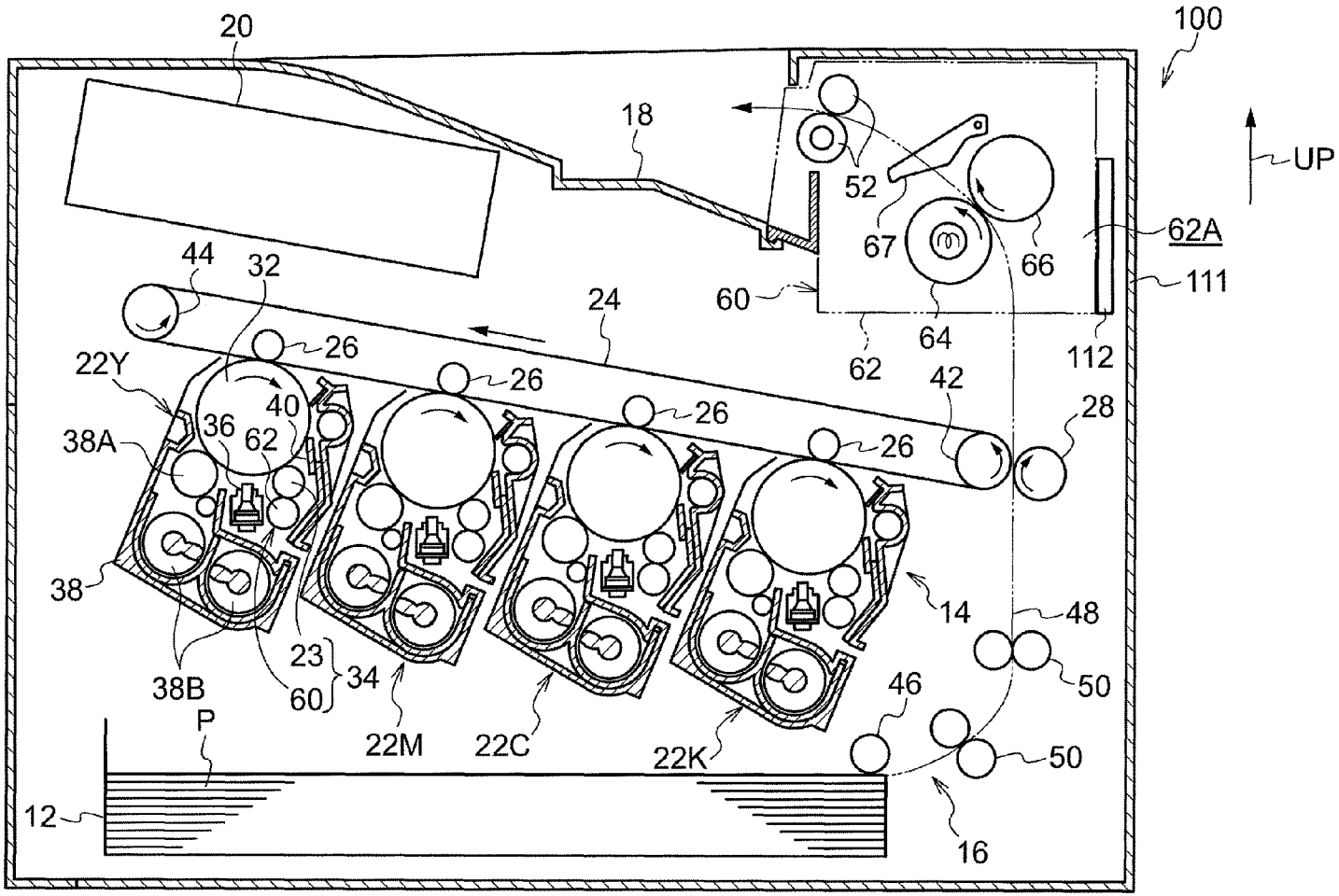
FIG. 2 is a schematic view showing a constitution of a single-sided image forming apparatus according to the exemplary embodiment.

Next, a constitution of a single-sided image forming apparatus 100 according to the exemplary embodiment will be described. FIG. 2 is a schematic view showing the constitution of the single-sided image forming apparatus 100 according to the exemplary embodiment. The arrow UP shown in FIG. 2 shows the upper side in the vertical direction. The same components as those in the double-sided image forming apparatus 10 are assigned the same reference numerals, and the description is appropriately omitted.

The single-sided image forming apparatus 100 according to the exemplary embodiment is an image forming apparatus for single-sided image formation, which forms an image on one side of the recording medium P. As shown in FIG. 2, the single-sided image forming apparatus 100 is provided with an image forming apparatus body 111 accommodating therein each component.

The image forming apparatus body 111 includes: an accommodating section 12 which accommodates the recording media P such as sheets; an image forming section 14 which forms an image on the recording medium P; a conveying section 16 which conveys the recording medium P from the accommodating section 12 to the image forming section 14; and a control section 20 which controls the operation of each section of the single-sided image forming apparatus 100. The image forming apparatus body 111 has in its upper portion an ejecting section 18 to which the recording medium P formed with an image by the image forming section 14 is ejected.

In the image forming apparatus body 111, a fixing device 60 fixing the toner image, which is transferred to the recording medium P by a second transfer roll 28 of the image forming section 14, to the recording medium P is provided at the downstream side in the conveying direction from a second transfer position. The fixing device 60 is provided with an ejection roll 52 which ejects the recording medium P fixed with the toner image to the ejecting section 18. In the single-sided image forming apparatus 100, the fixing device 60 is mounted in a manufacturing process in such a state that a passage surface member 80 to be described later is not attached to a fixing device body 62. A specific constitution of the fixing device 60 will be described later.

The image forming apparatus body 111 includes a cover 112 as an example of a closing member closing an opening 62A, which is formed in the fixing device body 62 by the fact that the passage surface member 80 to be described later is not mounted to the fixing device body 62. The image forming apparatus body 111 does not have a return passage 49A in the double-sided image forming apparatus 10.

Next, an image forming operation for forming an image on the recording medium P in the single-sided image forming apparatus 100 according to the exemplary embodiment will be described.

In the single-sided image forming apparatus 100 according to the exemplary embodiment, the recording medium P fed by the feed roll 46 from the accommodating section 12 is fed into the second transfer position by the plural conveying rolls 50.

Meanwhile, in the image forming units 22Y to 22K, the photoreceptor 32 charged by the charging roll 23 is exposed by the exposure device 36, and an electrostatic latent image is formed on the photoreceptor 32. The electrostatic latent image is developed by the developing device 38 to form a toner image on the photoreceptor 32. The toner image of each color formed in each of the image forming units 22Y to 22K is overlapped on the intermediate transfer belt 24 at the first transfer position to form a color image. The color image formed on the intermediate transfer belt 24 is then transferred to the recording medium P at the second transfer position.

The recording medium P transferred with the toner image is conveyed to the fixing device 60, and the transferred toner image is fixed by the fixing device 60. The recording medium P fixed with the toner image is ejected to the ejecting section 18 by the ejection roll 52. As described above, a series of image forming operations are performed.

(Constitution of Fixing Device 60 According to Exemplary Embodiment)

Figure 3:
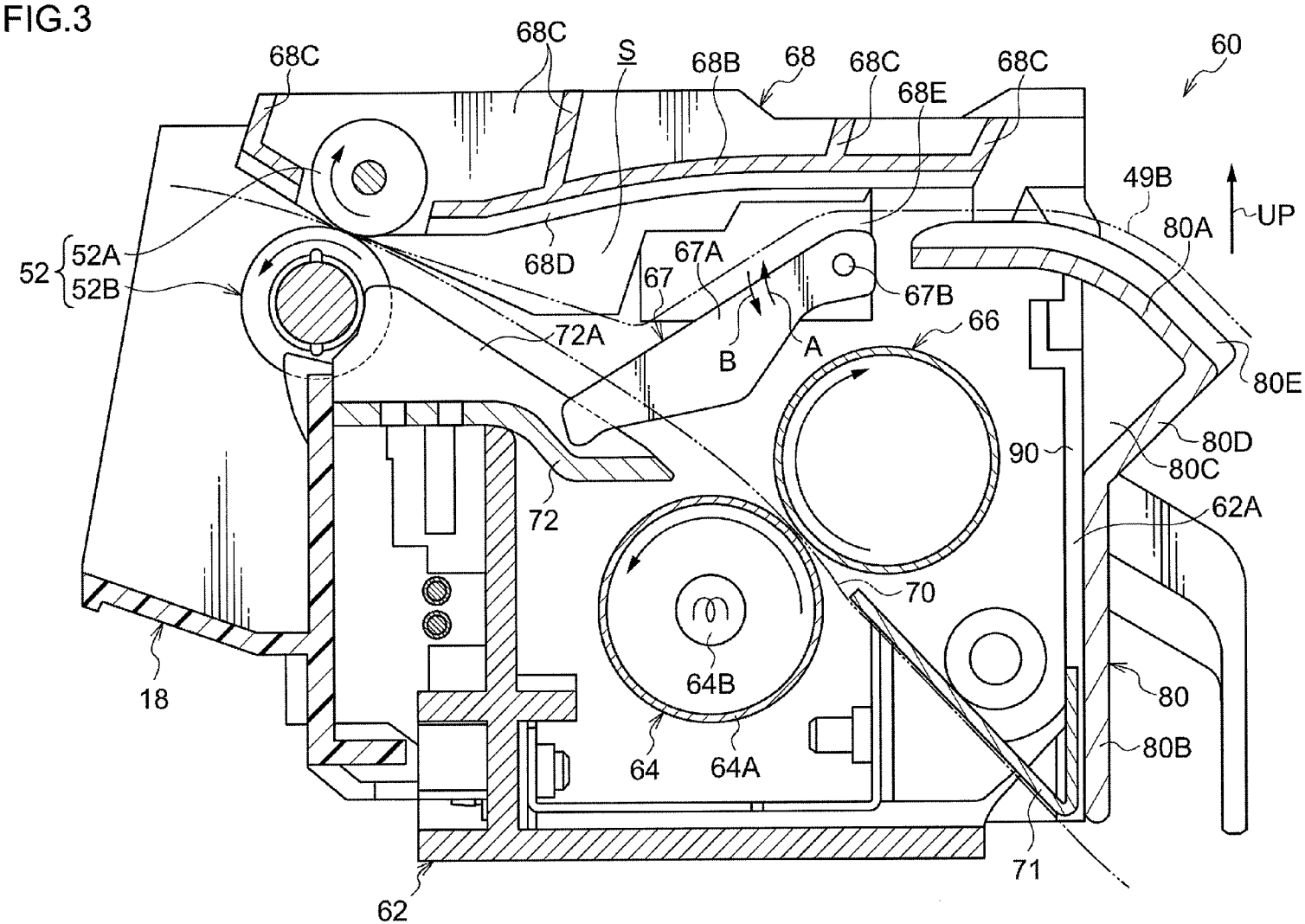
FIG. 3 is a cross-sectional view showing a constitution of a fixing device according to the exemplary embodiment.
Figure 4:
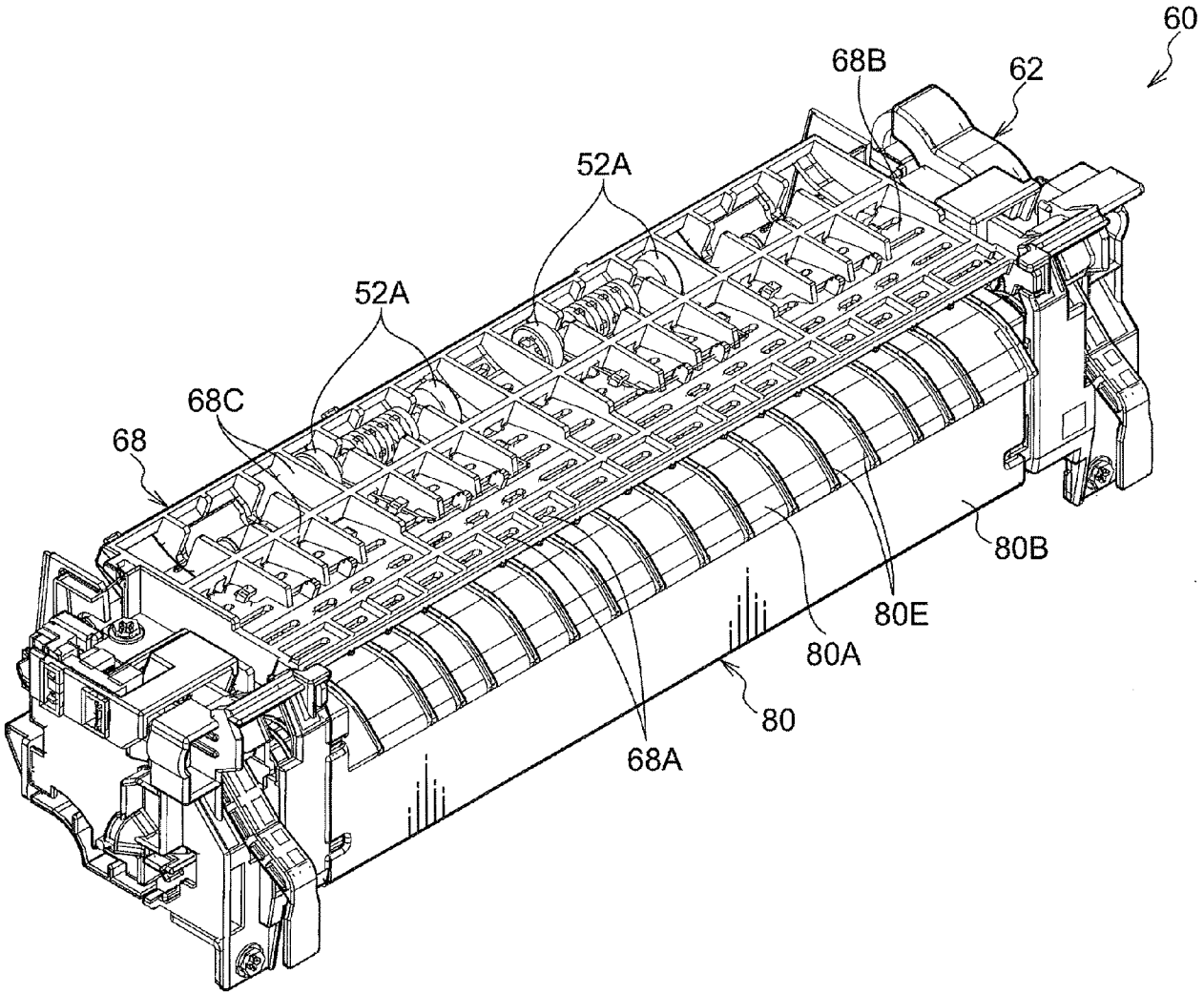
FIG. 4 is a perspective view showing a constitution of the fixing device according to the exemplary embodiment.

Next, a constitution of the fixing device 60 according to exemplary embodiment will be described. FIGS. 3 and 4 are schematic views showing the constitution of the fixing device 60 according to exemplary embodiment. The arrow UP shown in FIG. 3 shows the upper side in the vertical direction.

As shown in FIG. 3, the fixing device 60 according to exemplary embodiment is provided with the fixing device body 62 which may be attached to and detached from the image forming apparatus body 111 of the single-sided image forming apparatus 100 and the image forming apparatus body 11 of the double-sided image forming apparatus 10. The fixing device body 62 is provided with a heating roll 64 and a pressure belt 66 as an example of a fixing member fixing a toner image onto the recording medium P.

The heat roll 64 is configured to have a cylindrical-shaped cylindrical member 64A rotatably supported by the fixing device body 62 and a heat source 64B such as a halogen lamp provided in an internal space of the cylindrical member 64A. The pressure belt 66 is formed into an annular shape and is rotatably supported by the fixing device body 62 at a position facing the heating roll 64.

The heating roll 64 and the pressure belt 66 rotate in the width direction (hereinafter referred to as a recording medium width direction) as a rotation axis direction perpendicular to the conveying direction of the recording medium P (hereinafter referred to as a recording medium conveying direction), and the heating roll 64 and the pressure belt 66 have a length along the recording medium width direction.

In the heating roll 64 and the pressure belt 66, the heating roll 64 is rotated and driven and the pressure belt 66 is rotated in accordance with the heating roll 64, whereby the recording medium P transferred with a toner image is conveyed while being held between the heating roll 64 and the pressure belt 66. In the recording medium P being conveyed while being held between the heating roll 64 and the pressure belt 66, the heating roll 64 applies heat to toner and the pressure belt 66 applies pressure to the toner, whereby an image is fixed.

The fixing device body 62 is provided with a pair of ejection rolls 52 which ejects the recording medium P, which is fixed with a toner image by the heating roll 64 and the pressure belt 66, from the fixing device body 62 to the ejecting section 18. The pair of ejection rolls 52 is constituted of a driven roll 52A and a driving roll 52B disposed under the driven roll 52A.

The pair of ejection rolls 52 is not provided in the fixing device body 62, but may be provided in the image forming apparatus body 11 of the double-sided image forming apparatus 10 and the image forming apparatus body 111 of the single-sided image forming apparatus 100.

The fixing device body 62 is provided with an ejection passage 70 which introduces the recording medium P conveyed in the conveyance passage 48 provided in the image forming apparatus body 11 and the image forming apparatus body 111, to the ejecting section 18. In the ejection passage 70, a first guide member 71 guiding the recording medium P conveyed in the ejection passage 70, the heating roll 64, the pressure belt 66, the pair of ejection rolls 52, and a second guide member 72 guiding the recording medium P conveyed in the ejection passage 70 are disposed in this order along the recording medium conveying direction.

The first guide member 71 is configured to be in contact with the recording medium P, which is conveyed in the ejection passage 70, at the upper side of the ejection passage 70 and guides the recording medium P to a fixing position between the heating roll 64 and the pressure belt 66. The second guide member 72 is provided with a rib 72A which is formed along the recording medium conveying direction of the ejection passage 70. In the second guide member 72, the rib 72A is in contact with the recording medium P, which is conveyed in the ejection passage 70, at the lower side of the ejection passage 70, and the recording medium P is guided to an ejection position between the pair of the ejection rolls 52.

The fixing device body 62 has a space S as the introduction passage 49B in such a state that the fixing device body 62 is mounted to the image forming apparatus body 11 of the double-sided image forming apparatus 10 (hereinafter referred to as a double-sided mounted state).

Figure 5:
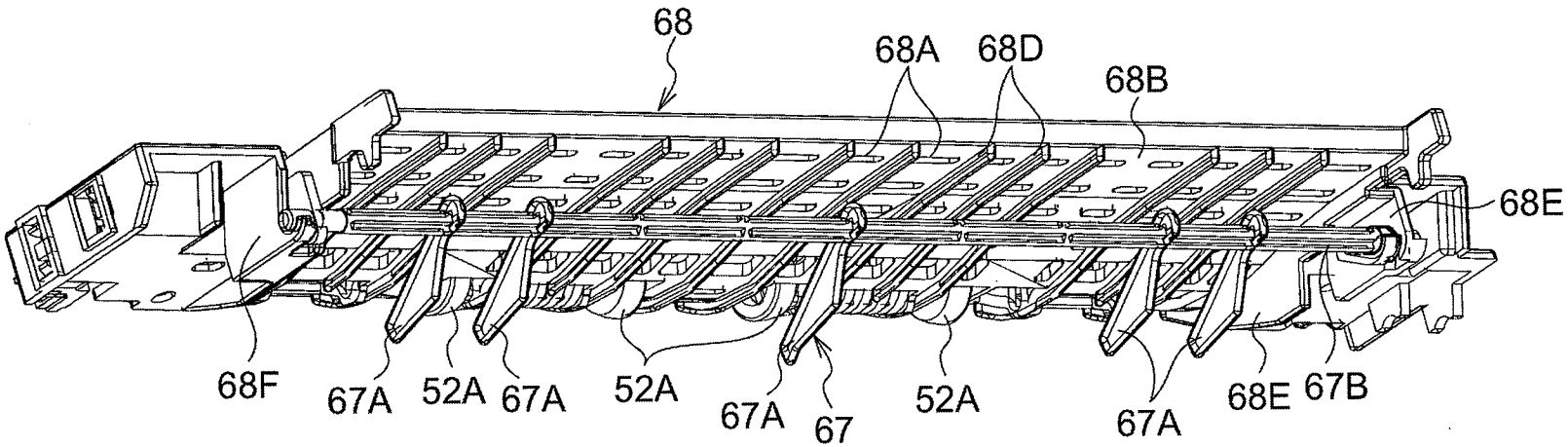
FIG. 5 is a perspective view showing a constitution of an upper cover and a detecting member according to the exemplary embodiment.

As shown in FIGS. 3 and 4, an upper cover 68 is removably attached to the upper portion of the fixing device body 2 as a covering member which covers the opened upper portion of the fixing device body 62. The upper cover 68 is configured to have: a plate-like base substrate 68B having plural openings 68A; plural first ribs 68C provided on the upper surface of the base substrate 68B along the recording medium conveying direction and the recording medium width direction; and plural second ribs 68D (see, FIG. 5) provided on the lower surface of the base substrate 68B along the recording medium conveying direction. As shown in FIG. 5, the upper cover 68 rotatably supports the driven rolls 52A so that the outer peripheries of the driven rolls 52A are exposed on the lower side of the base substrate 68B.

The second rib 68D of the base substrate 68B is operated as a guide section which guides the recoding medium P which is conveyed in the introduction passage 49B on the upper side of the introduction passage 49B in the double-sided mounted state.

In the upper cover 68, as shown in FIG. 3, a detecting member 67 as an example of a detection section detecting the recoding medium P is provided between the fixing position and the ejection position so as to face the second guide member 72.

The detecting member 67 is provided with a contact piece 67A as a contact member whose top end side is in contact with the recoding medium P conveyed in the ejection passage 70 and a rotation shaft 67B fixing the rear end side of the contact piece 67A and rotatably supported by the upper cover 68.

Figure 6:
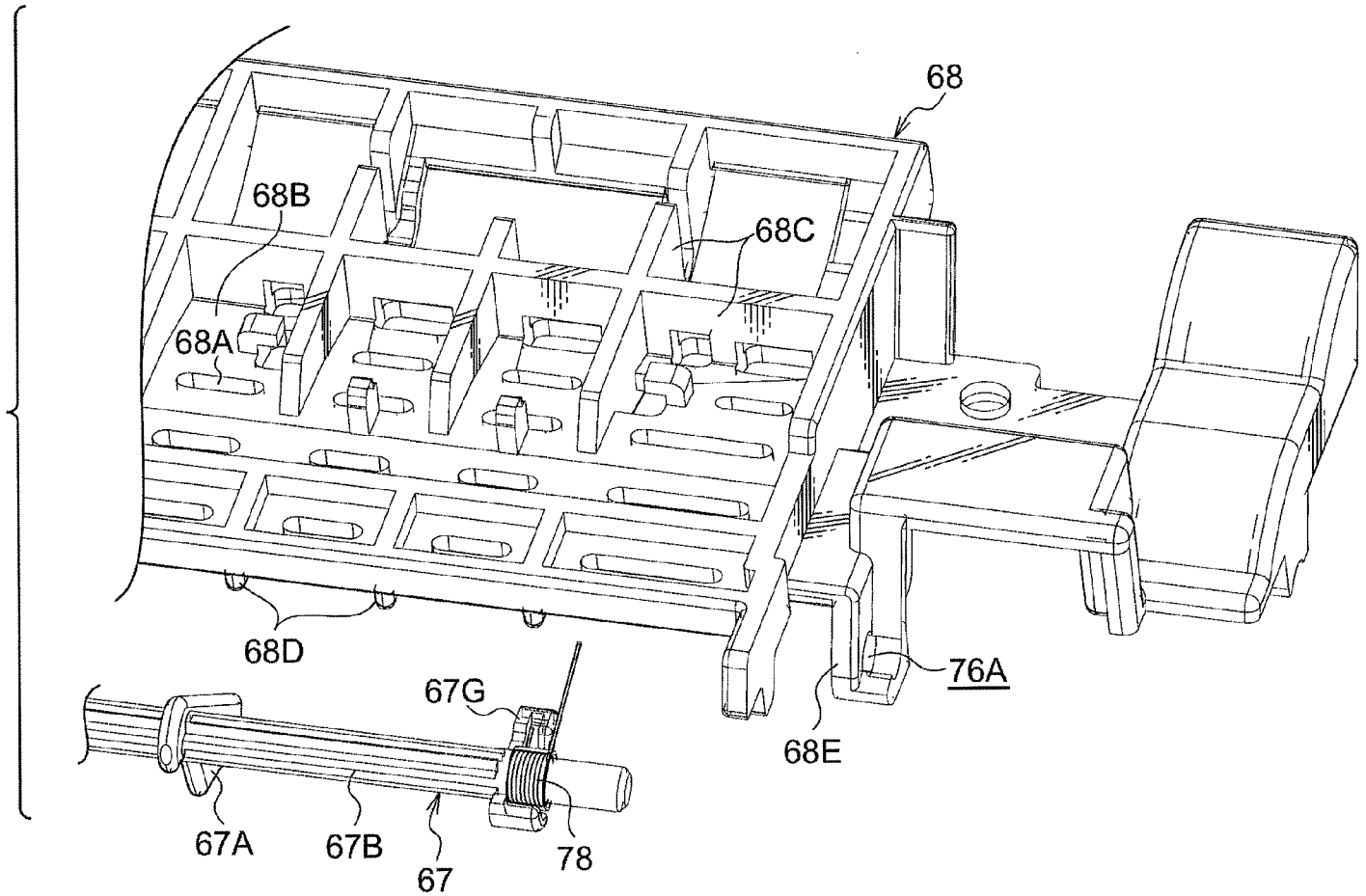
FIG. 6 is a perspective view showing one end side in a longitudinal direction of the upper cover according to the exemplary embodiment.

As shown in FIG. 5, a pair of side walls 68E and 68F is provided at the respective ends in the recording medium width direction of the base substrate 68B, and the pair of side walls 68E and 68F is an example of an attachment section to which the detecting member 67 is removably attached. As shown in FIG. 6, one side wall 68E has an insertion hole 76A through which one end in the axial direction of the rotation shaft 67B may be inserted.

Figure 7:
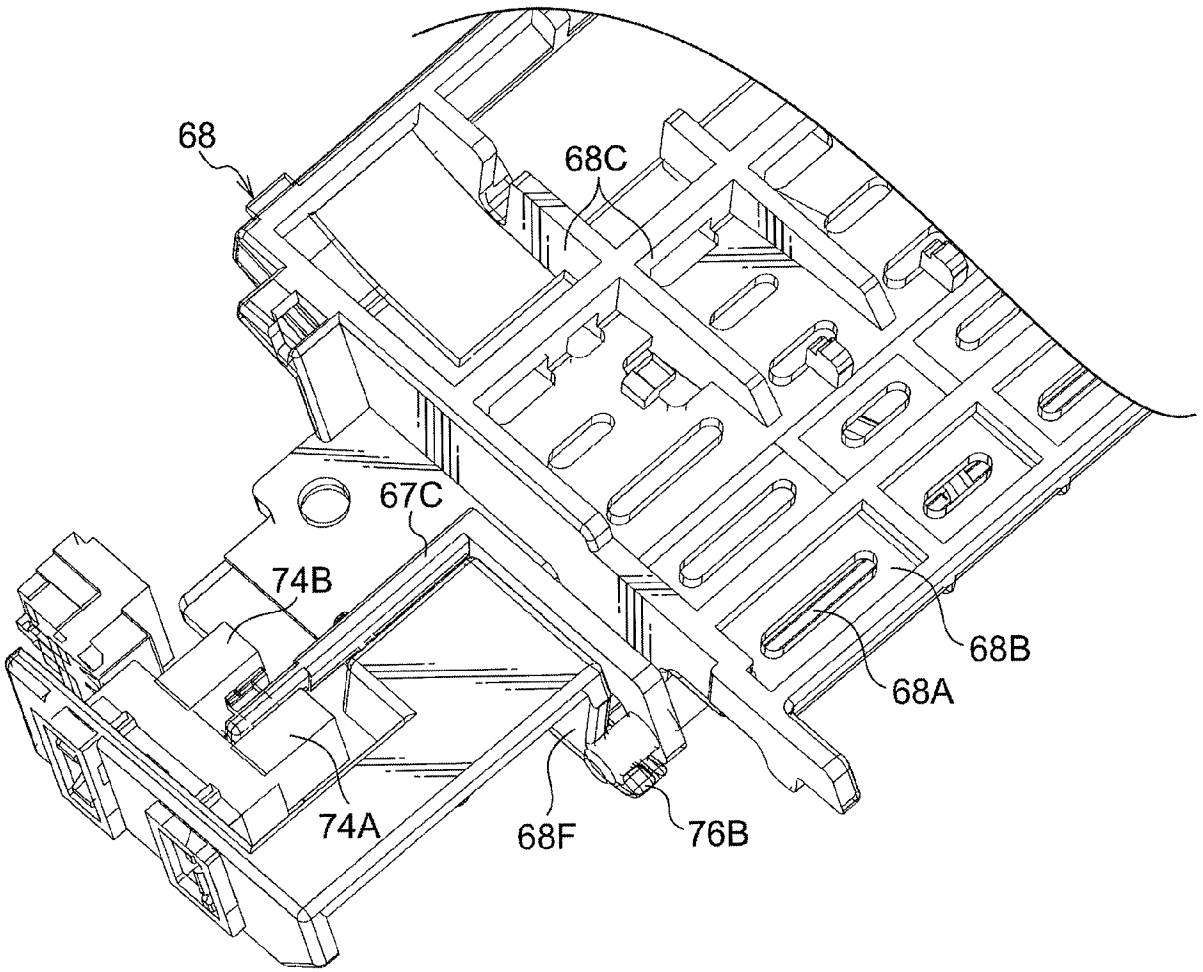
FIG. 7 is a perspective view showing the other end side in the longitudinal direction of the upper cover according to the exemplary embodiment.

As shown in FIG. 7, the other side wall 68F is provided with a placing section 76B which is formed in a circular arc whose upper side is open and on which the other end in the axial direction of the rotation shaft 67B may place. One end in the axial direction of the rotation shaft 67B is inserted through the insertion hole 76A and the other end in the axial direction of the rotation shaft 67B is placed on the placing section 76B, whereby the detecting member 67 is attached to the upper cover 68.

Figure 8:
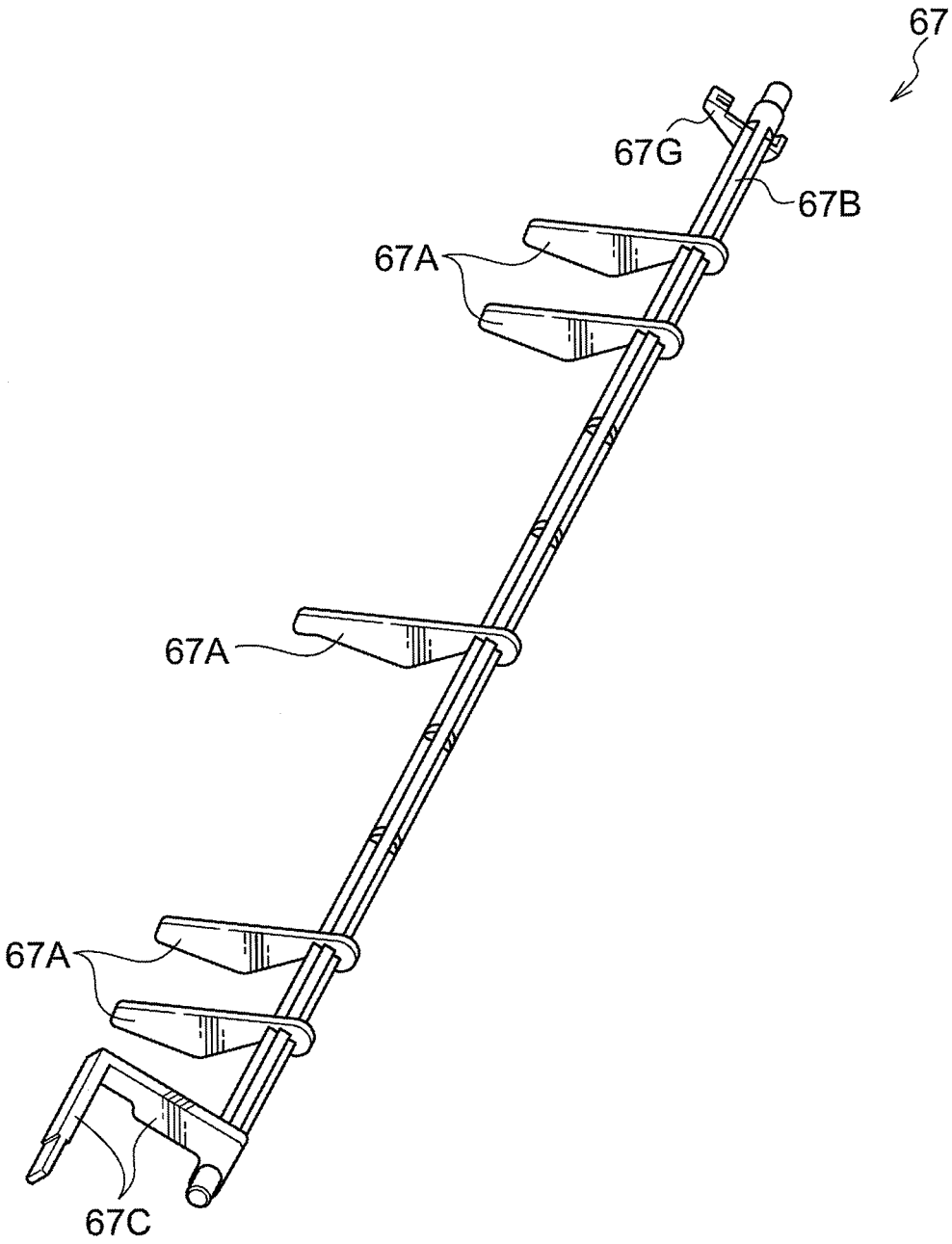
FIG. 8 is a perspective view showing the detecting member according to the exemplary embodiment.

As shown in FIG. 8, the plural contact pieces 67A are each formed into a plate-like shape and are arranged along the axial direction of the rotation shaft 67B. The rotation shaft 67B fixing the rear end side of the contact piece 67A is disposed above the pressure belt 66 as shown in FIG. 3. The front end side of the contact piece 67A extends toward the second guide member 72 side (obliquely leftward and downward in FIG. 3) so as to exist in the ejection passage 70 and is located at a contact position in contact with the recording medium P which is conveyed between the fixing position and the ejection position.

As shown in FIG. 6, a torsion spring 78 as an elastic member is provided at one end in the axial direction of the rotation shaft 67B, and the torsion spring 78 applies a force that rotates the contact piece 67A to the contact position to the detecting member 67 by virtue of the elastic force. Specifically, in the torsion spring 78, one end of the torsion spring 78 is in contact with the bottom surface of the base substrate 68B, and the other end is in contact with a receiving section 67G provided at one end in the axial direction of the rotation shaft 67B, whereby the force that rotates the rotation shaft 67B is applied to the detecting member 67 so that the contact piece 67A moves downward.

As shown in FIG. 3, the recording medium P conveyed by the heating roll 64 and the pressure belt 66 is in contact with the lower surface of the contact piece 67A to be pushed upward, whereby the contact piece 67A is rotated upward (in the arrow A direction in FIG. 3). After the recording medium P passes through the contact piece 67A, the contact piece 67A is rotated downward (in the arrow B direction in FIG. 3) by the elastic force of the torsion spring 78 to return to the original contact position. In such a state that the recording medium P does not pass between the fixing position and the ejection position, the contact piece 67A is located at the contact position. The position of the contact piece 67A shown in FIG. 3 is the contact position.

In the double-sided mounted state, the contact piece 67A guides the fixed recording medium P, which is conveyed in the introduction passage 49B by reverse rotation of the ejection roll 52, to the passage surface member 80. At this time, the contact piece 67A guides the recording medium P on the upper surface at the contact position. The contact piece 67A may be constituted so as to return to the original contact position by its own weight.

As shown in FIG. 7, an arm section 67C rotating integrally with the contact piece 67A and the rotation shaft 67B is provided at the other end in the axial direction of the rotation shaft 67B. The arm section 67C extends from the rotation shaft 67B in the radius direction of the rotation shaft 67B and then bends outside in the axial direction of the rotation shaft 67B.

In the fixing device body 62, a light-emitting section 74A and a light-receiving section 74B detecting whether or not the arm section 67C is disposed between the light-emitting section 74A and the light-receiving section 74B are arranged so as to face each other with a predetermined interval.

Thus, in such a state that the recording medium P does not push up the contact piece 67A, the contact piece 67A is disposed between the light-emitting section 74A and the light-receiving section 74B, and it is detected that the recording medium P does not pass (is not passing) between the fixing position and the ejection position.

When the recording medium P pushes up the contact piece 67A, the arm section 67C moves upward to retract from between the light-emitting section 74A and the light-receiving section 74B, and it is detected that the recording medium P passes (is passing) between the fixing position and the ejection position.

As described above, in the double-sided mounted state, based on a detection result obtained by detecting that the recording medium P passes (is passing) between the fixing position and the ejection position, the timing of reversing the recording medium P, that is, the timing of reversing the rotation of the ejection roll 52 is controlled.

For example, in such a state that the fixing device body 62 is mounted to the image forming apparatus body 11 of the single-sided image forming apparatus 100 (hereinafter referred to as a single-sided mounted state) and in the double-sided mounted state, as described above, it is detected that the recording medium P does not pass (is not passing) between the fixing position and the ejection position, whereby the occurrence of jamming of the recording medium P in the conveyance passage 48 is detected.

As the detection section detecting the recording medium P, a detecting member 167 (see, FIG. 9) may be used which is an example of the first detection section and is dedicated for the single-sided mounted state and a detecting member 267 (see, FIG. 10) which is an example of the second detection section and is dedicated for the double-sided mounted state.

Figure 9:
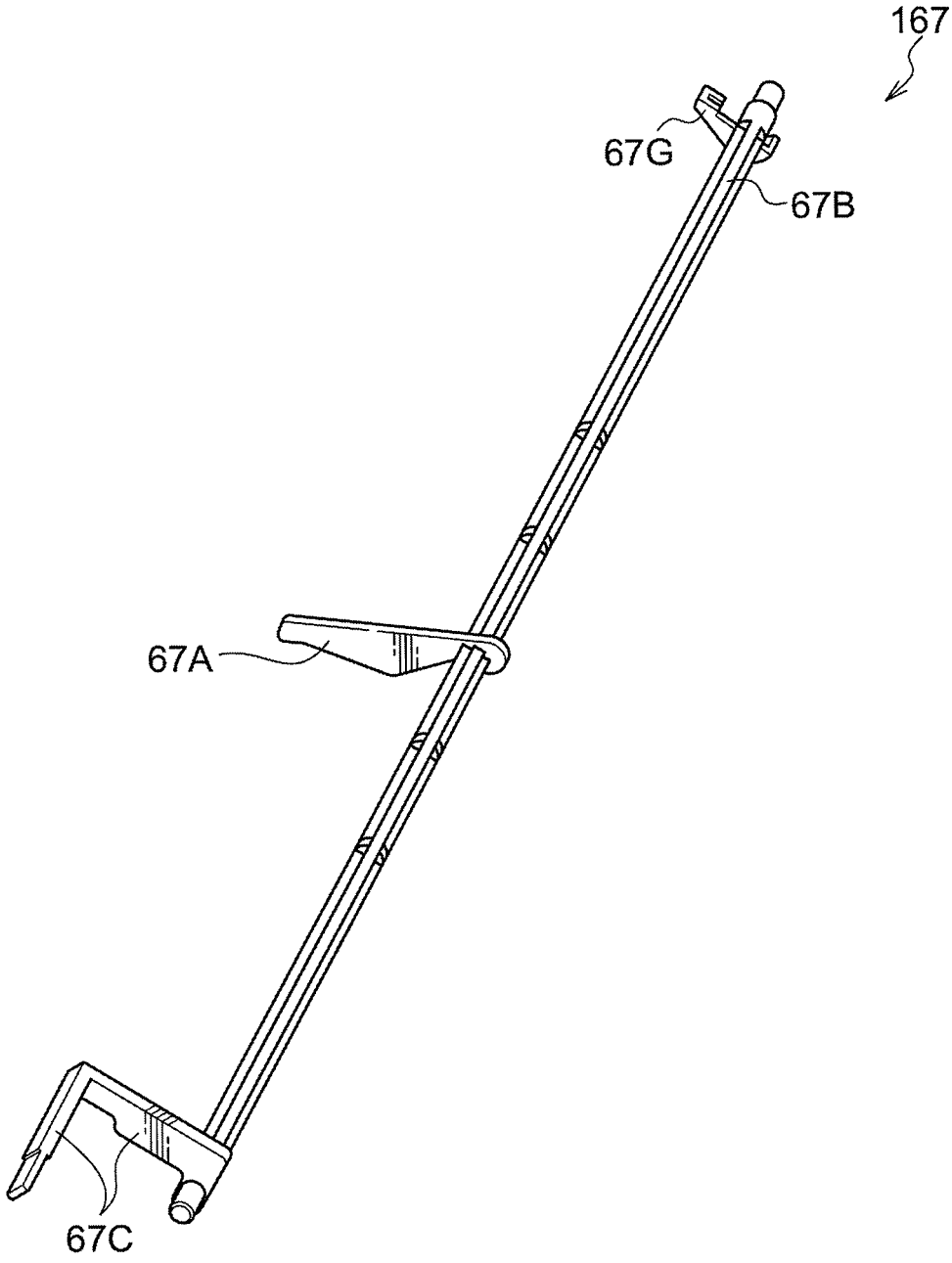
FIG. 9 is a perspective view showing a detecting member dedicated for a single-sided mounted state, according to the exemplary embodiment.

As shown in FIG. 9, in the detecting member 67, the detecting member 167 dedicated for the single-sided mounted state is configured to have single contact piece 67A disposed at the center in the axial direction of the rotation shaft 67B, instead of the plural contact pieces 67A.

Figure 10:
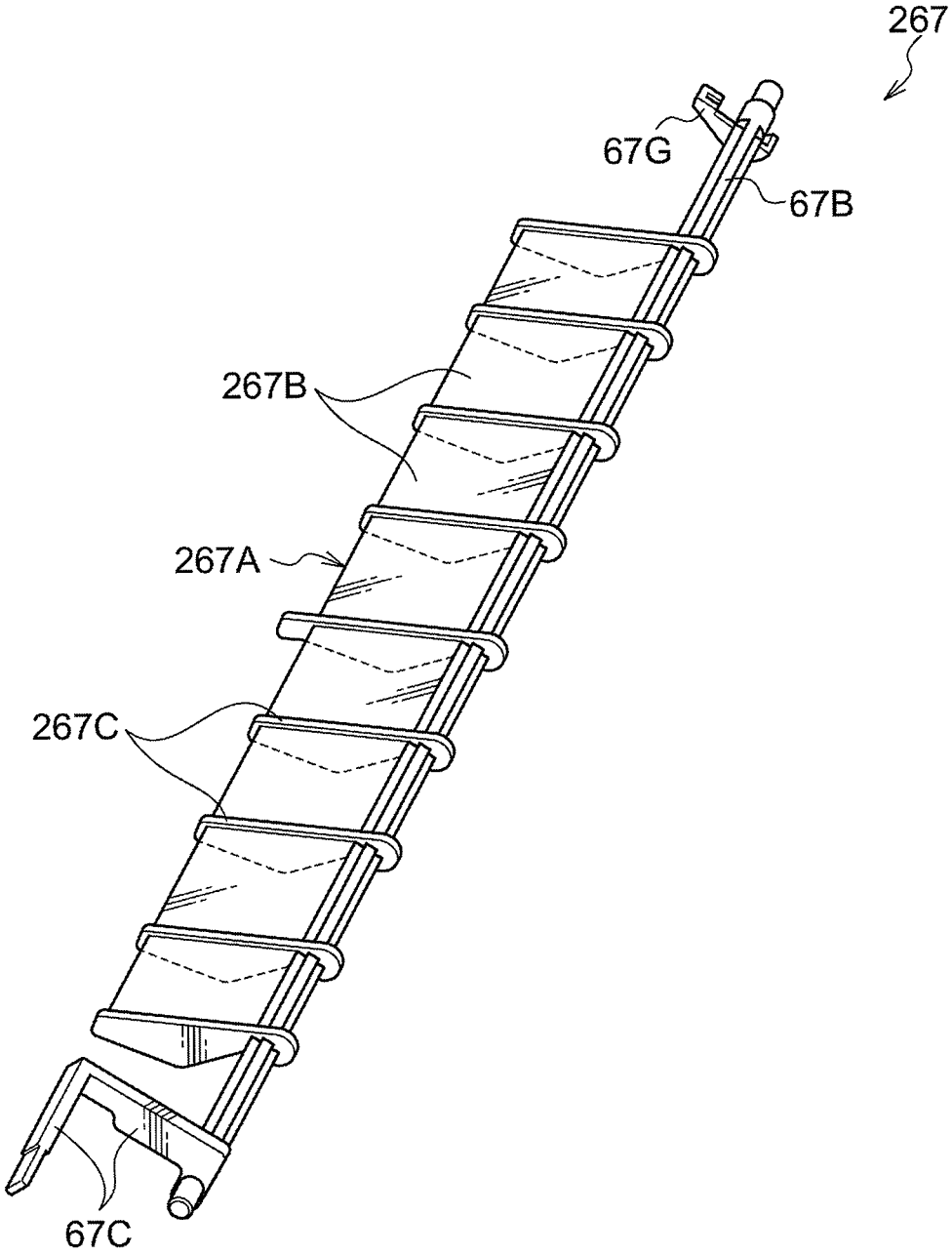
FIG. 10 is a perspective view showing a detecting member dedicated for a double-sided mounted state, according to the exemplary embodiment.

As shown in FIG. 10, in the detecting member 267 dedicated for the double-sided mounted state, in the detecting member 67, instead of the plural contact pieces 67A, a contact member 267A whose front end side is in contact with the recording medium P conveyed in the ejection passage 70 is fixed to the rotation shaft 67B. The contact member 267A has a length along the axial direction of the rotation shaft 67B. The contact member 267A is further provided with guide surfaces 267B guiding the recording medium P and ribs 267C provided on the guide surface 267B and provided along the recording medium conveying direction. The guide surface 267B extends in the recording medium conveying direction and the recording medium width direction.

As shown in FIG. 3, a pair of attachment sections 90 to which the passage surface member 80 having a passage surface of the introduction passage 49B may be attached is provided at the return passage 49A side in the fixing device body 62 (the right side in FIG. 3), that is, at the upstream side in the ejection passage 70 and the downstream side in the introduction passage 49B.

Figure 11:
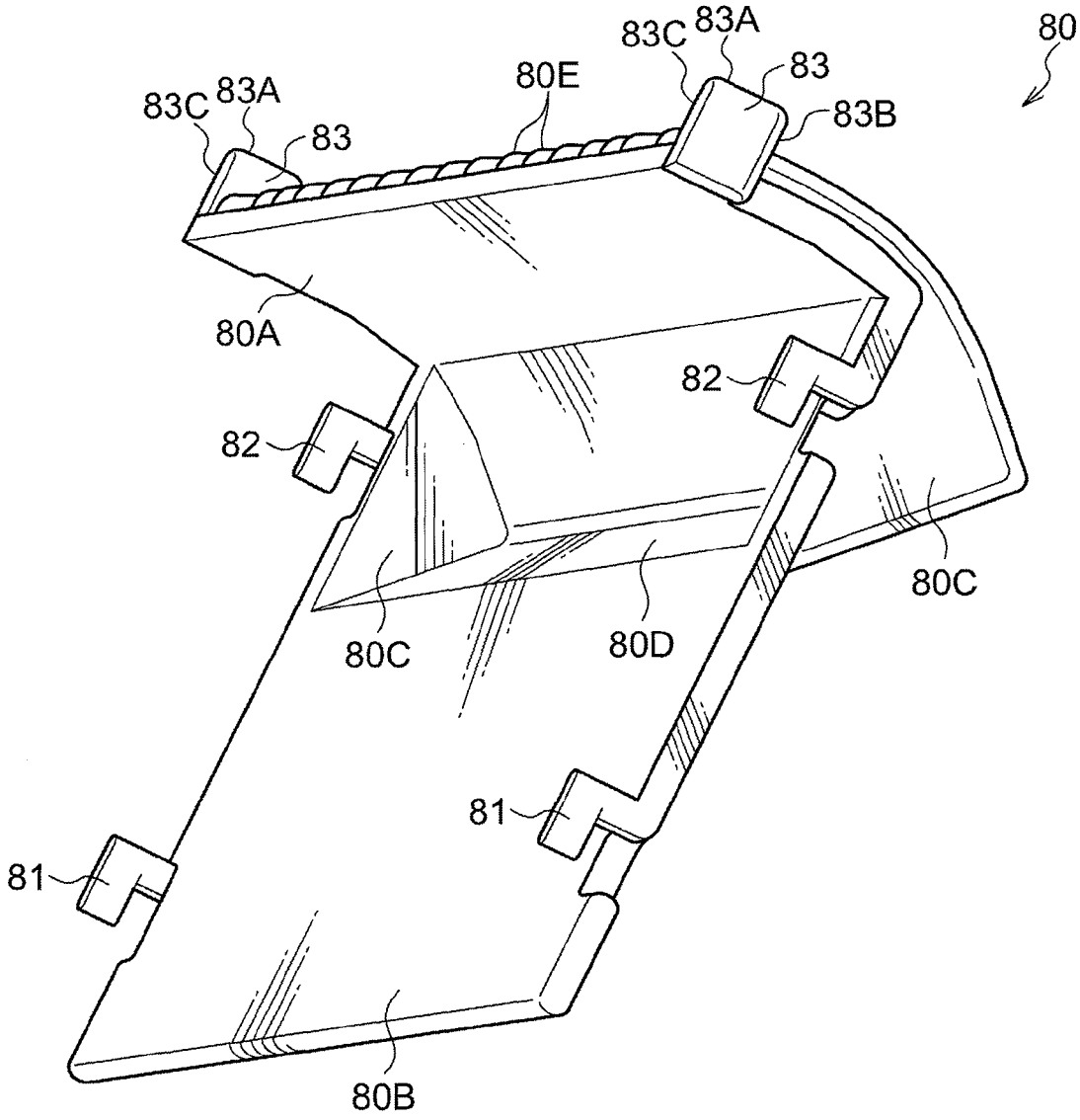
FIG. 11 is a perspective view showing a constitution of a passage surface member according to the exemplary embodiment.

As shown in FIG. 11, the passage surface member 80 is configured to have an upper wall 80A forming the upper portion of the passage surface member 80 and provided along the introduction passage 49B, a longitudinal wall 80B extending vertically in the attached state of the passage surface member 80 to the attachment section 90, a side wall 80C connecting laterally the upper wall 80A and the longitudinal wall 80B, and an intermediate wall 80D disposed between the upper wall 80A and the longitudinal wall 80B at the downstream side in the recording medium conveying direction with respect to the upper wall 80A. In the upper wall 80A, the downstream end in the recording medium conveying direction extends toward the return passage 49A side. The intermediate wall 80D slopes with respect to the longitudinal wall 80B under the upper wall 80A and connects the upper wall 80A and the longitudinal wall 80B with each other (see, FIG. 3).

Figure 12:
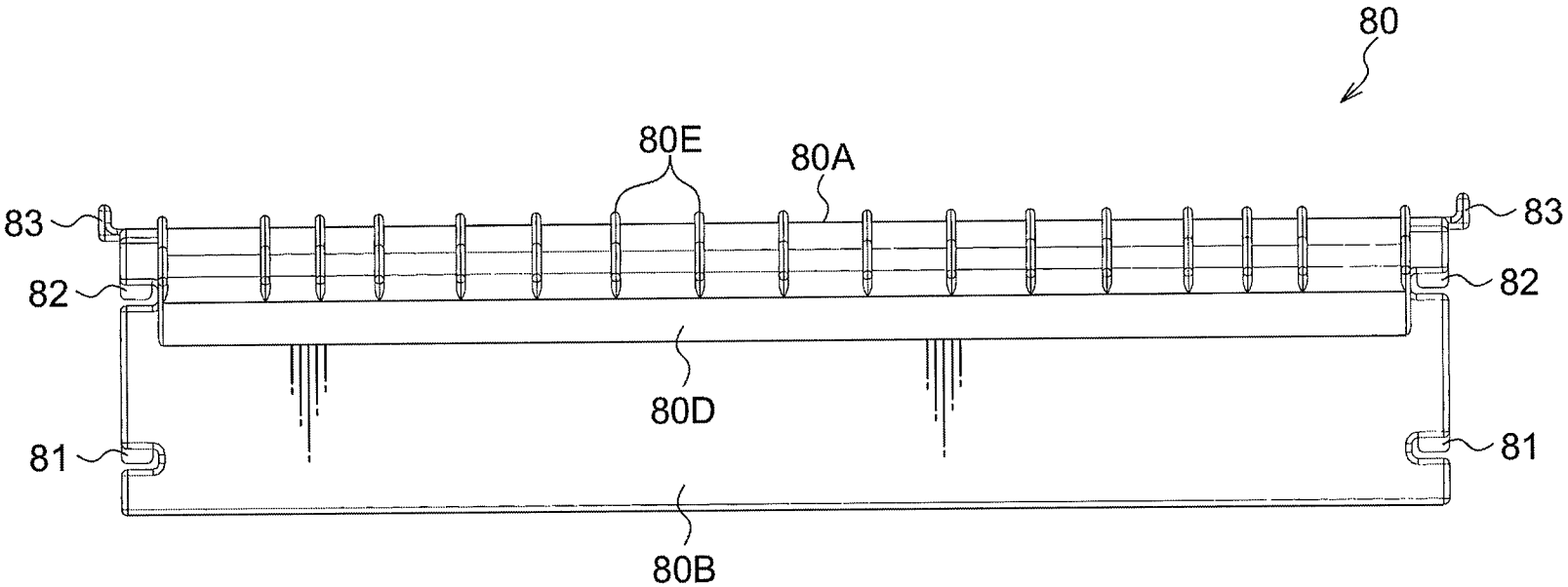
FIG. 12 is a front view showing a constitution of the passage surface member according to the exemplary embodiment.

As shown in FIG. 12, the upper wall 80A, the longitudinal wall 80B, and the intermediate wall 80D each have a length along the recoding medium width direction. As shown in FIG. 3, in such a state that the passage surface member 80 is attached to the attachment section 90, the longitudinal wall 80B is operated as a closing member closing the opening 62A of the fixing device body 62. In such a state that the opening 62A of the fixing device body 62 opens, the pressure belt 66 is exposed to the outside of the fixing device body 62.

The upper wall 80A has its upper surface plural ribs 80E provided along the recoding medium conveying direction. Namely, in the double-sided mounted state, the upper surface of the upper wall 80A constitutes the passage surface of the introduction passage 49B through which the fixed recoding medium fixed with an image is introduced into the return passage 49A.

As shown in FIG. 11, the lower sides of the side portions at the respective sides of the longitudinal wall 80B each have a first claw section 81 formed into an L-like shape in the lateral view. The side portions at the respective sides of the side wall 80C each have a second claw section 82 formed into an L-like shape in the lateral view and provided above the first claw section 81. The side portions at the respective sides of the upper wall 80A each have a third claw section 83 formed into an L-like shape in the front view (see, FIG. 12) and provided at the upstream side in the recording medium conveying direction.

Figure 13:
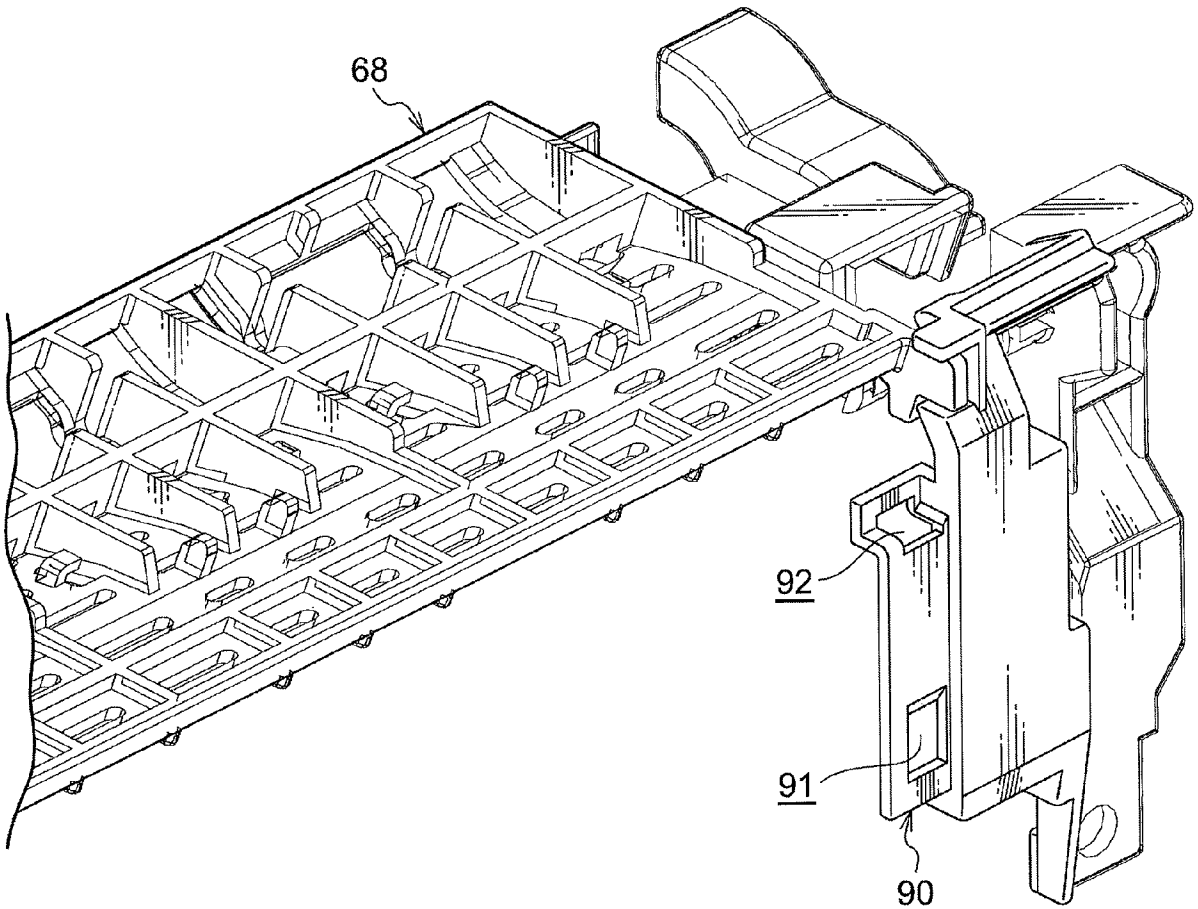
FIG. 13 is a perspective view showing a constitution of an attachment section for the passage surface member according to the exemplary embodiment.
Figure 14:
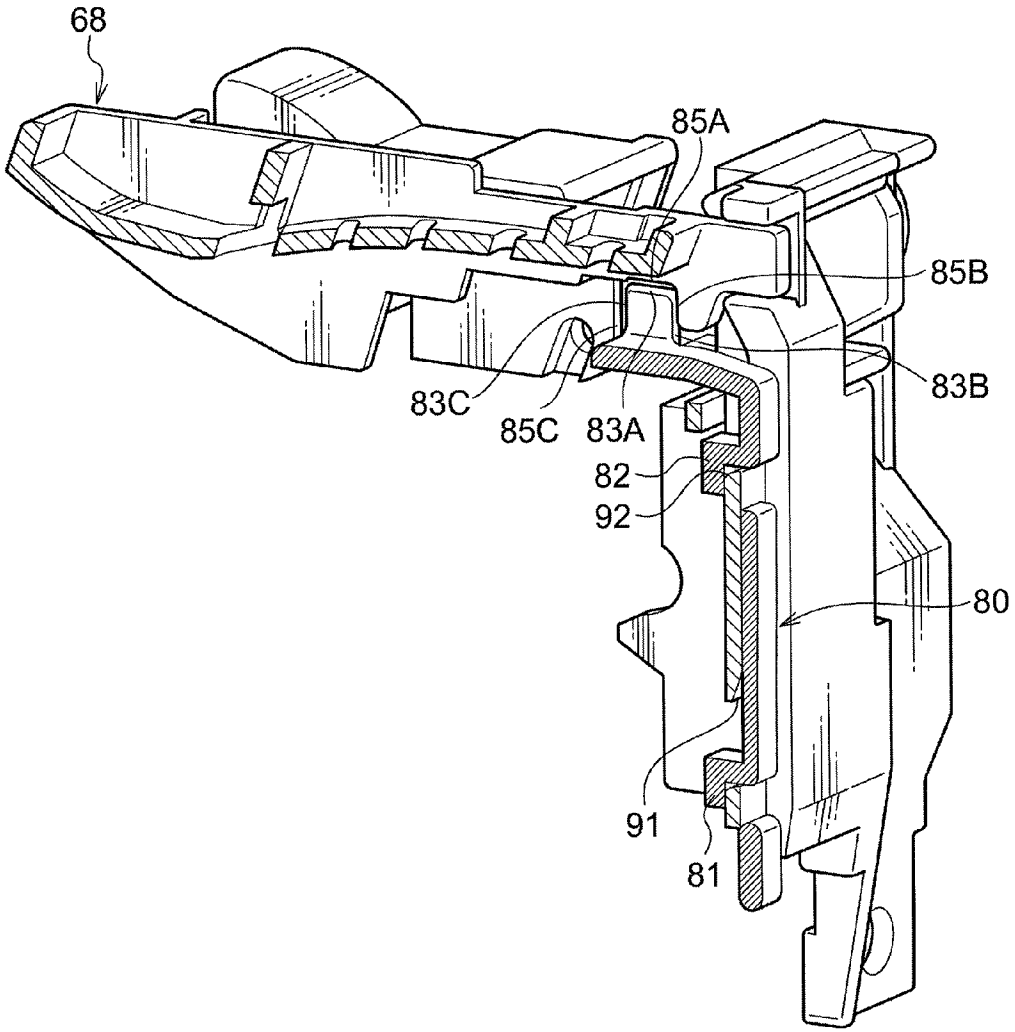
FIG. 14 is a perspective view showing a state in which the passage surface member is attached to the attachment section shown in FIG. 13.

As shown in FIGS. 13 and 14, a first insertion hole 91 through which the first claw section 81 is inserted is formed at the lower portion of the attachment section 90. A second insertion hole 92 through which the second claw section 82 is inserted is formed at the upper portion of the attachment section 90.

The second insertion hole 92 is opened upward, and the second claw section 82 may be inserted through the second insertion hole 92 from above. The first claw section 81 may be inserted through the first insertion hole 91 in the thickness direction of the first insertion hole 91, and the first insertion hole 91 has a size capable of vertically moving and sliding the first claw section 81 which is inserted through the first insertion hole 91.

The first claw section 81 hooks onto the edge of the first insertion hole 91 in a state of being inserted through the first insertion hole 91. The second claw section 82 hooks onto the edge of the second insertion hole 92 in a state of being inserted through the second insertion hole 92.

As shown in FIG. 14, the upper cover 68 is provided with a regulation section 85A which is in contact with the upper surface 83A of the third claw section 83 to regulate the upward movement of the passage surface member 80, in the attached state of the passage surface member 80 to the attachment section 90. Namely, the upper cover 68 is operated as a regulating member which regulates a separation of the passage surface member 80 from the attachment section 90 due to the upward movement of the passage surface member 80.

The upper cover 68 is further provided with regulation sections 85B and 85C which, in the attached state of the passage surface member 80 to the attachment section 90, are in contact respectively with an end surface 83B at the downstream side in the recording medium conveying direction in the third claw section 83 and an end surface 83C at the upstream side in the recording medium conveying direction in the third claw section 83 to regulate the inclination of the upper portion of the passage surface member 80 toward the upstream side in the recording medium conveying direction or the downstream side in the recording medium conveying direction. Namely, a recess is provided by the regulation sections 85A, 85B and 85C, and the third claw section 83 is fitted into the recess.

The passage surface member 80 is attached to the attachment section 90 of the fixing device body 62 in such a state that the upper cover 68 is removed from the fixing device body 62. The upper cover 68 is attached to the fixing device body 62 in such a state that the passage surface member 80 is attached to the attachment section 90 of the fixing device body 62, whereby the upper cover 68 regulates the movement and inclination of the passage surface member 80.

(Operation According to the Exemplary Embodiment)

Next, the operation according to the exemplary embodiment will be described. First, the case where the fixing device 60 is mounted to the double-sided image forming apparatus 10 will be described.

Figure 15:
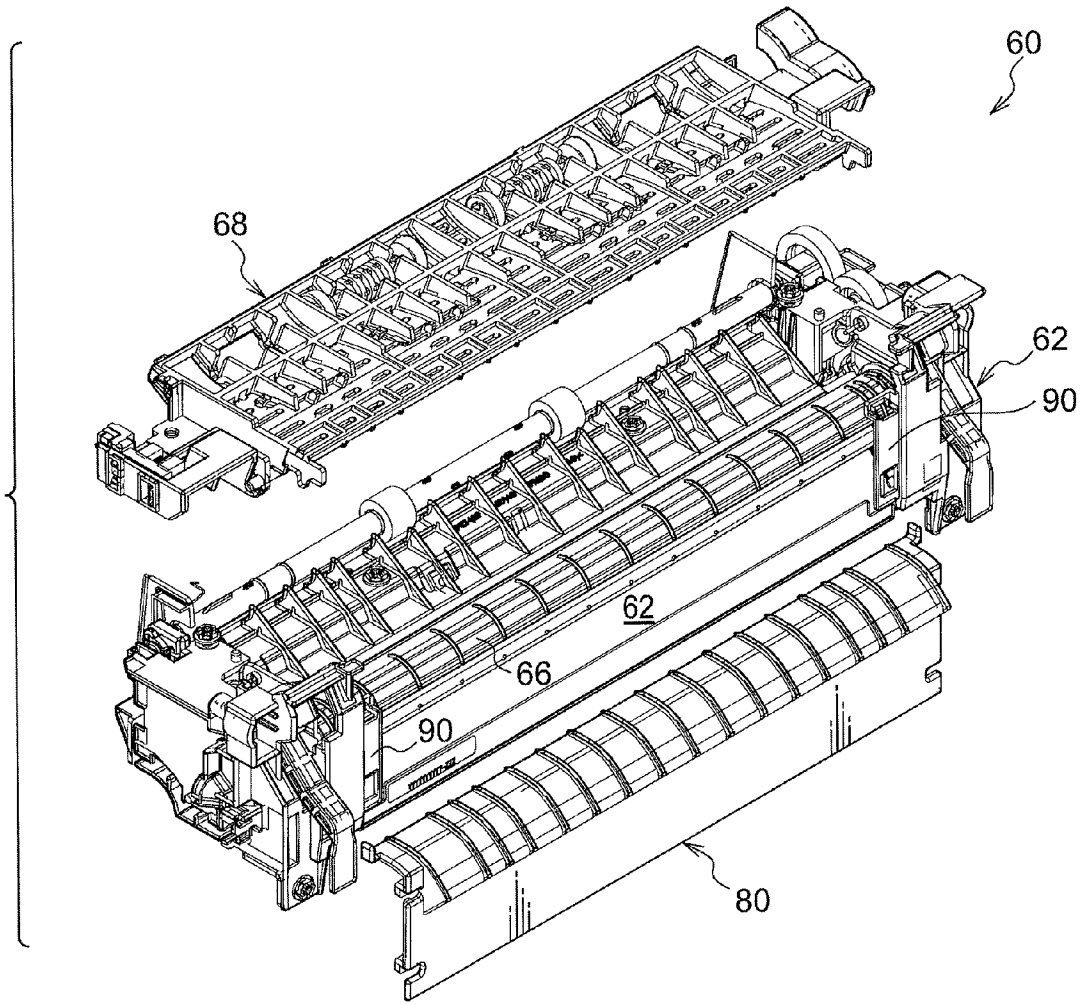
FIG. 15 is a perspective view showing a state in which an upper cover and the passage surface member are removed from a fixing device body according to the exemplary embodiment.
Figure 16:
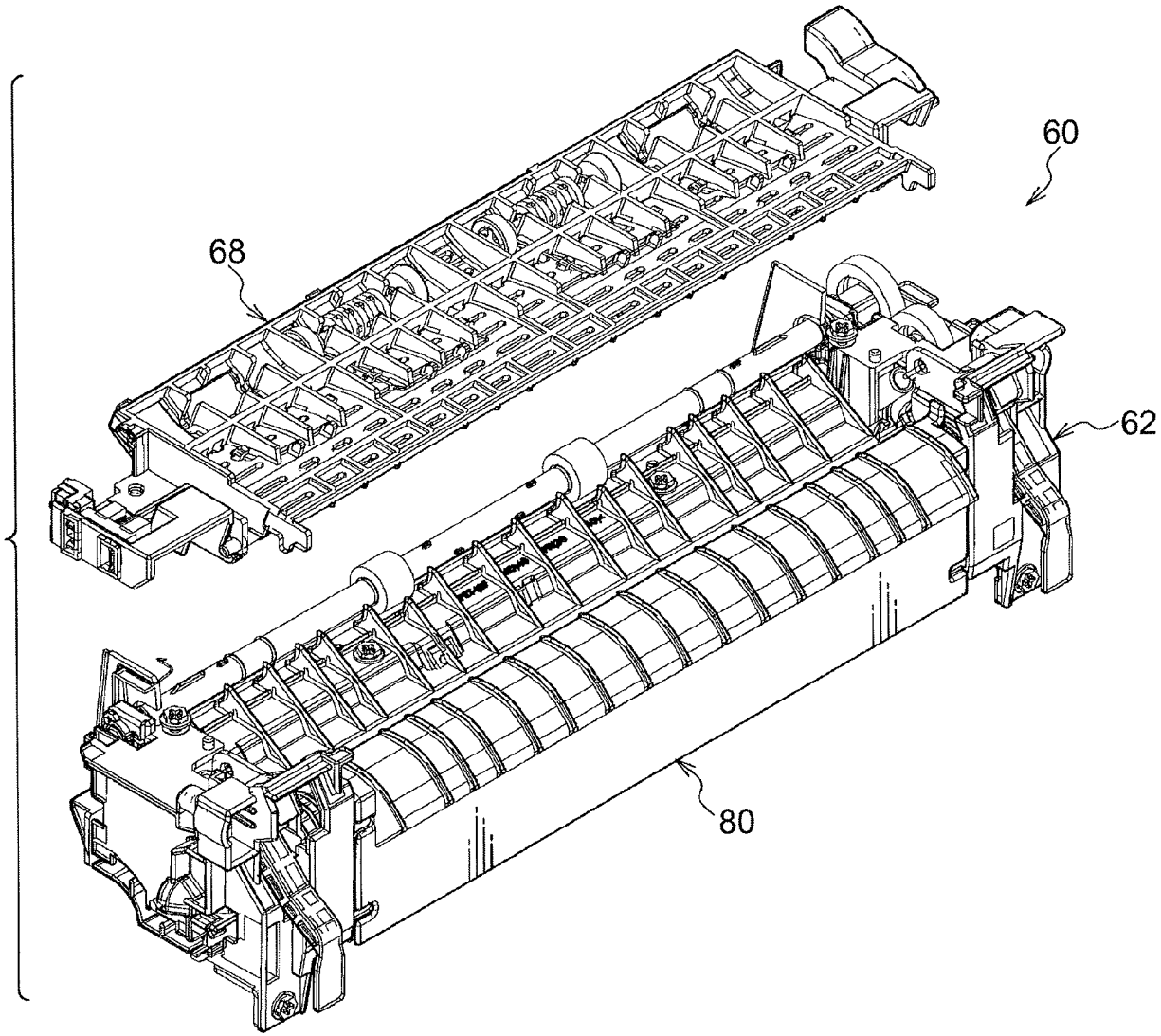
FIG. 16 is a perspective view showing a state in which the upper cover is removed from the fixing device body according to the exemplary embodiment.

In the case where the fixing device 60 is mounted to the double-sided image forming apparatus 10, with respect to the fixing device body 62 in such a state that the upper cover 68 is removed from the fixing device body 62 as shown in FIG. 15, the passage surface member 80 is attached to the attachment section 90 of the fixing device body 62 as shown in FIG. 16.

When the passage surface member 80 is attached to the attachment section 90, the first claw section 81 is first inserted through the first insertion hole 91. Thereafter, the passage surface member 80 is slid and moved downward, whereby the second claw section 82 is inserted through the second insertion hole 92. According to this constitution, the passage surface member 80 is attached to the attachment section 90 (see, FIG. 14).

The first claw section 81 hooks onto the edge of the first insertion hole 91 in a state of being inserted through the first insertion hole 91, and the second claw section 82 hooks onto the edge of the second insertion hole 92 in a state of being inserted through the second insertion hole 92. According to this constitution, the movement of the passage surface member 80 toward the return passage 49A side (toward the downstream side in the conveying direction) in the introduction passage 49B is regulated (see, FIG. 14).

Then, the upper cover 68 is attached to the fixing device body 62 (see, FIG. 4). According to this constitution, as shown in FIG. 14, the regulation section 85A of the upper cover 68 is in contact with the upper surface 83A of the third claw section 83 to regulate the upward movement of the passage surface member 80. The regulation sections 85B and 85C of the upper cover 68 are in contact respectively with the end surfaces 83B and 83C of the third claw section 83 to regulate the inclination of the upper portion of the passage surface member 80 toward the upstream side in the recording medium conveying direction or the downstream side in the recording medium conveying direction. This constitution maintains such a state that the regulation section 85A of the upper cover 68 is in contact with the upper surface 83A of the third claw section 83. Consequently, the separation of the passage surface member 80 from the attachment section 90 due to the upward movement of the passage surface member 80 is regulated to prevent the detachment of the passage surface member 80 from the attachment section 90.

The detecting member 67 detects the recording medium P in the double-sided mounted state and has a function of guiding the recording medium P, which is conveyed in the introduction passage 49B, to the return passage 49A, and therefore, it is not necessary to exchange the detecting member 67. The detecting member 267 dedicated for the double-sided mounted state may be used, and, in this case, the detecting member 267 is attached to a pair of the side walls 68E and 68F of the upper cover 68 (see, FIG. 10).

The fixing device 60 in such a state that the passage surface member 80 is attached to the attachment section 90 is mounted to the image forming apparatus body 11 of the double-sided image forming apparatus 10 (see, FIG. 1). In such a state that the passage surface member 80 is attached to the attachment section 90, the opening 62A of the fixing device body 62 is closed by the side wall 80B of the passage surface member 80.

Figure 17:
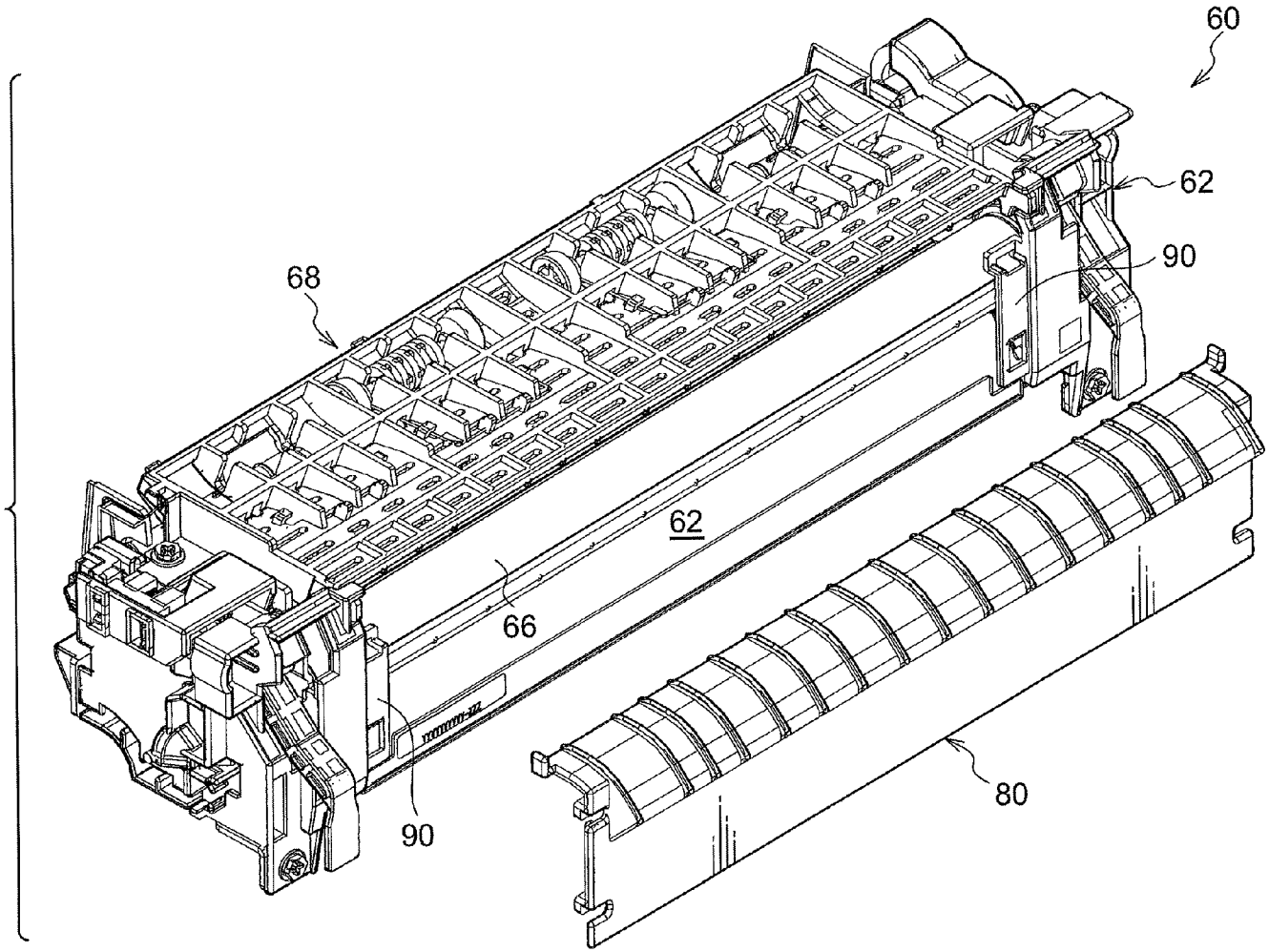
FIG. 17 is a perspective view showing a state in which the passage surface member is removed from the fixing device body according to the exemplary embodiment.

When the passage surface member 80 is detached from the attachment section 90, the second claw section 82 is first removed from the second insertion hole 92 while sliding and moving the passage surface member 80 upward. Finally, the first claw section 81 is removed from the first insertion hole 91. According to this constitution, the passage surface member 80 is detached from the attachment section 90. Then, as shown in FIG. 17, the upper cover 68 is attached to the fixing device body 62.

Next, the case where the fixing device 60 is mounted to the single-sided image forming apparatus 100 will be described.

When the fixing device 60 is mounted to the single-sided image forming apparatus 100, the upper cover 68 is attached to the fixing device body 62 in such a state that the passage surface member 80 is detached from the attachment section 90 of the fixing device body 62, as shown in FIG. 15.

Since the detecting member 67 has a function of guiding the recording medium P in the single-sided mounted state, it is not necessary to exchange the detecting member 67. The detecting member 167 dedicated for the single-sided mounted state may be used, and, in this case, the detecting member 167 is attached to a pair of the side walls 68E and 68F of the upper cover 68 (see, FIG. 9).

The fixing device 60 in such a state that the passage surface member 80 is detached from the attachment section 90 is mounted to the image forming apparatus body 111 of the single-sided image forming apparatus 100 (see, FIG. 1). In such a state that the passage surface member 80 is detached from the attachment section 90, the opening 62A of the fixing device body 62 which has been closed by the side wall 80B of the passage surface member 80 is opened. However, the opening 62A is closed by the cover 112 provided in the image forming apparatus body 111.

As described above, in the fixing device 60 according to the exemplary embodiment, the passage surface member 80 is attached to and removed from the attachment section 90 of the fixing device body 62, whereby the fixing device 60 is used commonly in the single-sided image forming apparatus 100 and the double-sided image forming apparatus 10.

The invention is not limited to the above exemplary embodiment and may be variously modified, changed, and improved. For example, the fixing device 60 may be exchanged by a user, and the user may exchange the single-sided image forming apparatus for the double-sided image forming apparatus.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to be suited to the particular use contemplated. It is intended that the scope of the invention be defined by the following claims and their equivalents.

What is claimed is:

1. A fixing device comprising:

a fixing device body that is adapted to attach to and detach from an apparatus body of a double-sided image forming apparatus which comprises a return passage through which a recording medium is returned to an image forming position in order to form an image on both sides of the recording medium, and of a single-sided image forming apparatus which does not comprise the return passage;

a fixing member that is provided in the fixing device body and that fixes an image to the recording medium; and a first attachment section that is provided at a return passage side in the fixing device body; and a passage surface member that is adapted to attach to and detach from the first attachment section, and comprises a passage surface of an introduction passage through which a fixed recording medium on which an image has been fixed by the fixing member is introduced into the return passage, wherein the passage surface member is attached to the first attachment section to form a double-sided image forming apparatus and is detached from the first attachment section to form a single-sided image forming apparatus without changing the fixing device body.

2. The fixing device of claim 1, further comprising a detection section that detects the recording medium in a state in which the fixing device is mounted to the apparatus body of the single-sided image forming apparatus, that detects the recording medium in a state in which the fixing device is mounted to the apparatus body of the double-sided image forming apparatus, and that guides the fixed recording medium to the passage surface member.

3. The fixing device of claim 1, wherein the fixing device body comprises a second attachment section that is adapted to have one of a first detection section, which detects the recording medium in a state in which the fixing device is mounted to the apparatus body of the single-sided image forming apparatus, or a second detection section, which detects the recording medium and which guides the fixed recording medium to the passage surface member in a state in which the fixing device is mounted to the apparatus body of the double-sided image forming apparatus, attached thereto.

4. The fixing device of claim 1, wherein the passage surface member serves as a closing member which closes an opening of the fixing device body.

5. The fixing device of claim 1, wherein the passage surface member is moved downward relative to the first attachment section and is attached at the first attachment section, whereby a claw section of the passage surface member hooks onto the first attachment section and the first attachment section regulates movement of the passage surface member toward the return passage side in the introduction passage, and the fixing device further comprises a regulating member that is provided in an upper portion of the fixing device body, that guides the recording medium being conveyed in the introduction passage, and that is in contact with the upper portion of the passage surface member and regulates upward movement of the passage surface member.

6. A single-sided image forming apparatus comprising:

an apparatus body that does not comprise a return passage through which a recording medium is returned to an image forming position in order to form an image on both sides of the recording medium;

the fixing device comprising:

a fixing device body that is adapted to attach to and detach from an apparatus body of a double-sided image forming apparatus which comprises a return passage through which a recording medium is returned to an image forming position in order to form an image on both sides of the recording medium, and of a single-sided image forming apparatus which does not comprise the return passage;

a fixing member that is provided in the fixing device body and that fixes an image to the recording medium; and a first attachment section that is provided at a return passage side in the fixing device body and that is adapted to have a passage surface member, which comprises a passage surface of an introduction passage through which a fixed recording medium on which an image has been fixed by the fixing member is introduced into the return passage, attached thereto, wherein the fixing device is in a state in which the passage surface member is not attached to the fixing device; and a closing member that is provided within the apparatus body and that closes an opening which is formed in a fixing device body of the fixing device due to the passage surface member not being attached thereto.

7. The single-sided image forming apparatus of claim 6, further comprising a detection section that detects the recording medium in a state in which the fixing device is mounted to the apparatus body of the single-sided image forming apparatus, that detects the recording medium in a state in which the fixing device is mounted to the apparatus body of the double-sided image forming apparatus, and that guides the fixed recording medium to the passage surface member.

8. The single-sided image forming apparatus of claim 6, wherein the fixing device body comprises a second attachment section that is adapted to have one of a first detection section, which detects the recording medium in a state in which the fixing device is mounted to the apparatus body of the single-sided image forming apparatus, or a second detection section, which detects the recording medium and which guides the fixed recording medium to the passage surface member in a state in which the fixing device is mounted to the apparatus body of the double-sided image forming apparatus attached thereto.

9. A double-sided image forming apparatus comprising:

an apparatus body that comprises a return passage through which a recording medium is returned to an image forming position in order to form an image on both sides of the recording medium; and the fixing device of claim 1 in a state in which the passage surface member is attached to the fixing device.

10. The double-sided image forming apparatus of claim 9, further comprising a detection section that detects the recording medium in a state in which the fixing device is mounted to the apparatus body of the single-sided image forming apparatus, that detects the recording medium in a state in which the fixing device is mounted to the apparatus body of the double-sided image forming apparatus, and that guides the fixed recording medium to the passage surface member.

11. The double-sided image forming apparatus of claim 9, wherein the fixing device body comprises a second attachment section that is adapted to have one of a first detection section, which detects the recording medium in a state in which the fixing device is mounted to the apparatus body of the single-sided image forming apparatus, or a second detection section, which detects the recording medium and which guides the fixed recording medium to the passage surface member in a state in which the fixing device is mounted to the apparatus body of the double-sided image forming apparatus, attached thereto.

12. The double-sided image forming apparatus of claim 9, wherein the passage surface member serves as a closing member which closes an opening of the fixing device body.

13. The double-sided image forming apparatus of claim 9, wherein the passage surface member is moved downward relative to the first attachment section and is attached at the first attachment section, whereby a claw section of the passage surface member hooks onto the first attachment section and the first attachment section regulates movement of the passage surface member toward the return passage side in the introduction passage, and the fixing device further comprises a regulating member that is provided in an upper portion of the fixing device body, that guides the recording medium being conveyed in the introduction passage, and that is in contact with the upper portion of the passage surface member and regulates upward movement of the passage surface member.

* * * * *